United States Patent [19]

Hughes et al.

[11] 4,155,516

[45] May 22, 1979

[54] WEB CUTTING AND SPLICING APPARATUS

[75] Inventors: Theodore R. Hughes, Tulsa, Okla.; Glenn L. McCarty, 6319 S. 45th West Ave., Tulsa, Okla. 74132

[73] Assignee: Glenn L. McCarty, Tulsa, Okla.

[21] Appl. No.: 883,536

[22] Filed: Mar. 6, 1978

Related U.S. Application Data

[63] Continuation-in-part of Ser. No. 808,448, Jun. 21, 1977.

[51] Int. Cl.[2] ..... B65H 19/18; B65H 19/20

[52] U.S. Cl. ..... 242/58.1; 242/56 R

[58] Field of Search ..... 242/56R, 58.1, 58.2, 242/58.3, 58.4, 58.5, 58, 67.1 R; 156/502, 509, 507

[56] References Cited

U.S. PATENT DOCUMENTS

| | | | |
|---|---|---|---|
| 2,644,645 | 7/1953 | Bevevino | 242/56 R |
| 3,637,153 | 1/1972 | King | 242/56 R |
| 3,693,900 | 9/1972 | Bohn | 242/56 R |

*Primary Examiner*—Edward J. McCarthy

*Attorney, Agent, or Firm*—Head, Johnson & Chafin

[57] ABSTRACT

A web cutter and splicer for cutting a continuous web of material into relatively short lengths and winding the cut lengths onto a storage roll and which comprises a pulley for initially receiving the continuous moving web thereover and a solenoid actuated clamping or holding device for receiving the web from the pulley and intermittently holding the web against movement. The web also moves around an alignment device and through a solenoid actuated cutting apparatus operably connected with the aligning device for actuation whereby the web is severed at preselected position in order that the severed portion of the web may be wound on the storage roll, said preselected position being selected in such a manner as to facilitate a subsequent splicing of the severed portions of the web into a restored continuous web.

7 Claims, 5 Drawing Figures

WEB CUTTING AND SPLICING APPARATUS

CROSS-REFERENCE TO RELATED APPLICATION

This application is a continuation-in-part application of our co-pending application Ser. No. 808,448, filed June 21, 1977, and entitled "Web Cutting and Splicing Apparatus."

BACKGROUND OF THE INVENTION

1. Field of the Invention

This invention relates to improvements in cutting and splicing devices and more particularly, but not by way of limitation, to a device for cutting a continuous web of material at substantially precisely preselected positions on the web to provide relatively short pieces and winding the short pieces onto a storage roll.

2. Description of the Prior Art

In many instances, it is desirable to sever a continuously moving web of material into relatively short predetermined lengths whereby the severed short lengths may be wound onto a suitable storage roll for facilitating handling of the material. For example, in the movie industry, the houses wherein a movie is to be shown normally receives the film as stored on a plurality of film reels, each having approximately two thousand feet of film wound or stored thereon. The plurality of short lengths of film must be spliced together into a single continuous strip or web for projection thereof with the usual movie projection equipment. When the "run" of the movie at one particular movie house has expired and the film is to be shipped or otherwise transported to the next movie house wherein the film is to be shown, the continuous strip of film must be cut apart into lengths of approximately two thousand feet and rewound on the storage reels for shipment. Normally this procedure requires that the movie house personnel, such as the projectionist, remain after the last showing of the film for approximately three hours, depending, of course, on the length of the entire movie contained on the film strip, for running the film through the usual presently available apparatus for cutting the film into the desired lengths and rewinding the two thousand foot lengths of film onto the shipping reels. The disadvantages of this method and means of cutting the continuous film strip into the required shorter lengths and rewinding the severed film sections onto the shipping reels will be apparent. In addition, when a film strip has been repeatedly cut and spliced, it is difficult to realign the spliced sections of the film strip in such a manner that continuity of the film is maintained, and after many such operations, some of the frames of the film may be completely lost, or at least distorted, which interferes with the desirable showing of the film.

SUMMARY OF THE INVENTION

The present invention contemplates a novel apparatus for substantially automatically cutting a continuous web into preselected lengths and winding the severed lengths of the material onto suitable storage rolls. In the movie industry, as hereinbefore set forth, the continuous film strip may be cut into the desired shorter lengths and rewound onto the storage reels simultaneously with the last showing of the film at the movie house, thus greatly reducing the time the personnel must remain subsequent to the last showing of the film for preparing the film for shipment. The novel apparatus comprises a first pulley for receiving the continuously moving web thereover and directing the web into and through a clamping or holding device, over an aligning device, through a cutting device, and onto a storage roll. The clamping or holding device is preferably actuated by a suitable solenoid which is responsive to a signal received from the moving web for intermittently momentarily stopping the movement of the web, or at least slowing the movement of the web down in order that the movement may be stopped by the aligning device. The cutting device is also preferably actuated by a solenoid simultaneously with the actuation of the clamping device for severing the continuous web and freeing the severed portion from the remaining web, thus providing a preselected length of the web on the storage roll. The cutting device also adheres the newly cut end of the remaining portion of the web to a leader of an empty storage roll whereby the moving web begins to wind onto the new storage roll. The operation may be repeated until the entire web has been cut into the desired lengths and wound onto a plurality of storage rolls.

The aligning device is particularly designed and constructed for receiving the film strip therearound in a manner wherein the position of each frame of the film is in a preselected aligned position whereby the moment the forward movement of the film strip is interrupted, the portion of the film strip position in the cutting device will be so aligned that the cutting apparatus will sever the film at substantially precisely between a pair of consecutive frames. In this manner, when the film strip is restored to a continuous strip stage, the continuity of the material contained on the film is maintained. The novel cutting and splicing apparatus is simple and efficient in operation and economical and durable in construction.

DESCRIPTION OF THE PREFERRED EMBODIMENTS

Figure 1:
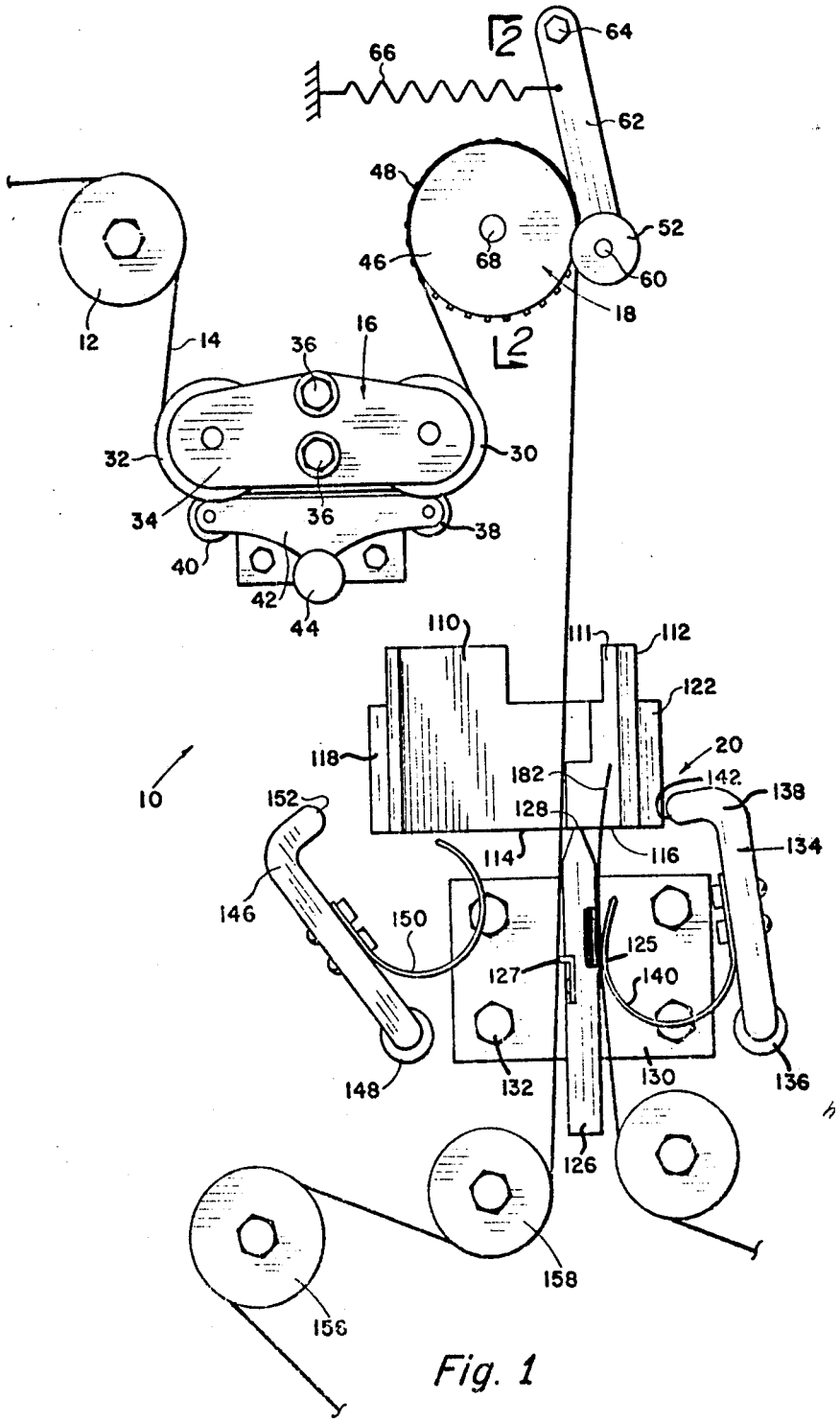
FIG. 1 is a front elevational view of a web cutting and splicing apparatus embodying the invention, and illustrating only the working elements thereof.

Referring to the drawings in detail, and particularly FIGS. 1 through 4, reference character 10 generally indicates a web cutting and splicing apparatus comprising a pulley 12 suitably journalled on a support wall, or the like, 13 (FIG. 2) of a suitable housing (not shown) such as illustrated in our aforementioned co-pending application, and for initially receiving a substantially continuously moving web 14 therearound. Whereas the web 14 may be of any suitable material, such as fabric, paper, or the like, the web 14 as shown herein is preferably a movie film strip. A braking or clamping apparatus generally indicated at 16 is suitably mounted on the support wall (not shown) in spaced relation with respect to the pulley 12 for receiving the travelling web or film strip 14 therethrough for a purpose and in a manner as will be hereinafter set forth. An alignment apparatus generally indicated at 18 is suitably mounted on the support wall 13 in spaced relation with respect to the clamping apparatus and receives the travelling web 14 therearound in a manner and for a purpose as will be hereinafter set forth. A cutting apparatus generally indicated at 20 is mounted on or carried by the support wall in spaced relation with respect to the alignment apparatus 18 and also receives the travelling web 14 therethrough. It is preferable to provide at least two take-up or storage reels as shown at 22 and 24 in FIG. 5 and which are suitably journalled on the support wall in mutually spaced relationship and in spaced relation to the cutting apparatus 20. The reels 22 and 24 are each driven by an independent motor 26 and 28, respectively, and alternately receive the web 14 thereon for moving the web 14 from the pulley 12 to the respective reel in a manner and for a purpose as will be hereinafter set forth.

The braking apparatus 16 comprises a pair of spaced spools or sensing rollers 30 and 32 journalled between a pair of spaced mounting plates, only one of which is shown at 34 in FIG. 1. The sensing rollers 30 and 32 are freely rotatable about their respective axes and are of a sufficient length for receiving the film strip 14 thereover in the same manner as set forth in our afore-mentioned co-pending application. A spacer block (not shown) is preferably interposed between the rollers 30 and 32 and is secured to the mounting plate or plates 34 in any well known manner, such as by bolts 36. A pair of spaced pressure rollers 38 and 40 are journalled on a suitable bracket member 42 for free rotation about their own axes and normally bear against the outer periphery of the sensing rollers 30 and 32. The bracket 42 may be secured to the support wall 13 in any suitable manner, and the position of the bracket 42 with respect to the plates 34 may be varied, if desired, by manual manipulation thereof by a suitable handle or knob 44. The web 14 passes over the first pulley 12, between the rollers 30–32 and respective pressure rollers 38–40, and over the alignment apparatus 18 as clearly shown in FIG. 1. The pressure engagement of the rollers 38 and 40 with the sensing rollers 30 and 32 maintains the web 14 in efficient contact with the sensing rollers for a purpose as will be hereinafter set forth.

Figure 2:
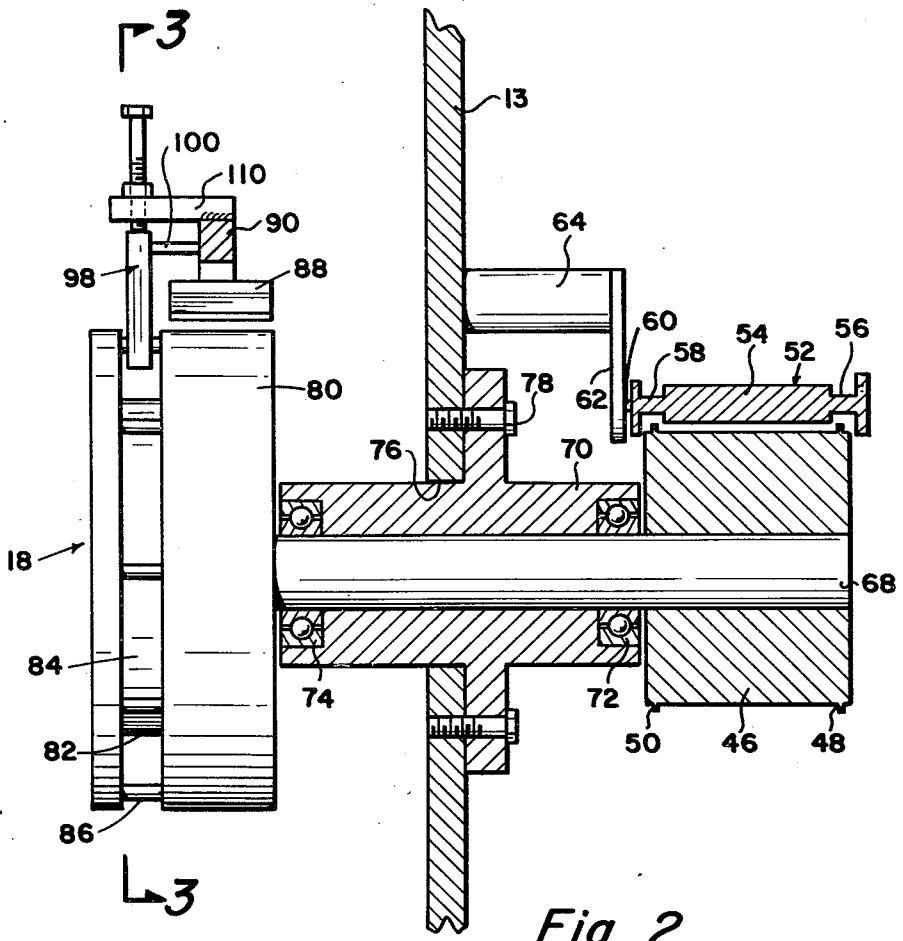
FIG. 2 is a sectional view taken on line 2—2 of FIG. 1.
Figure 3:
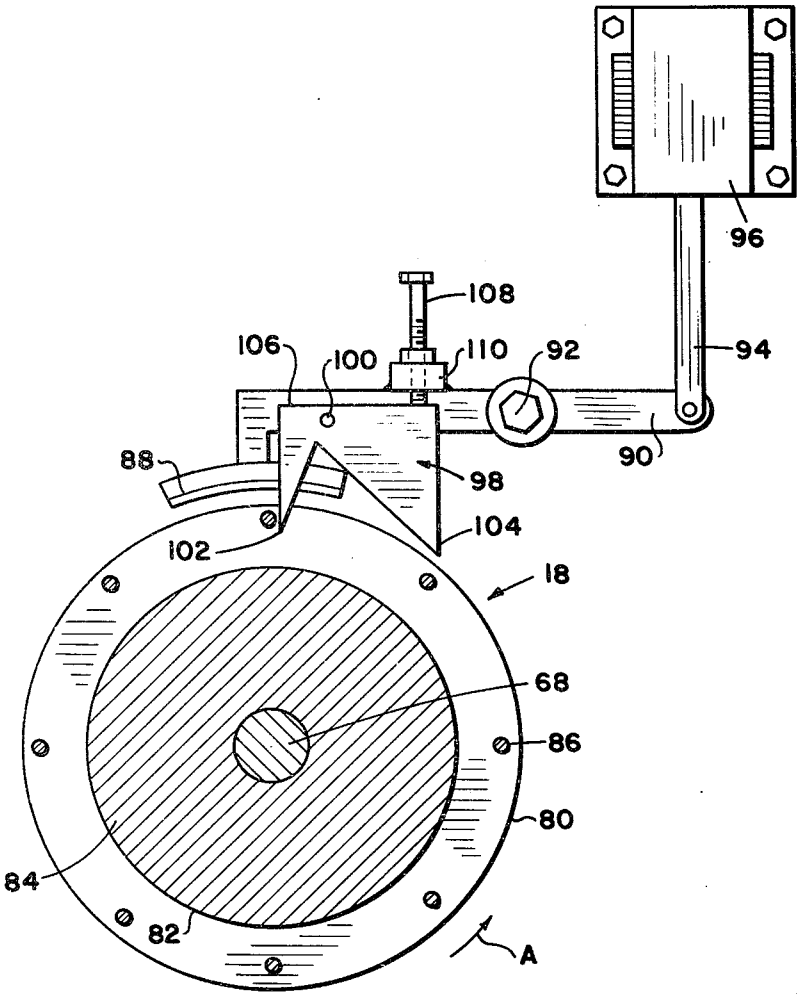
FIG. 3 is a sectional view taken on line 3—3 of FIG. 2.

Referring now more particularly to FIGS. 2 and 3, the alignment apparatus 18 comprises a roller 46 of a width slightly greater than the width of the usual film strip 14, and is provided with a first set of spaced outwardly projecting teeth 48 extending around the outer circumference thereof in the proximity of one end thereof. The teeth 48 are spaced a distance apart substantially equal to the distance between the perforations of one side of the strip 14 and engage each perforation during use of the apparatus 10. A second set of similar teeth 50 are circumferentially spaced around the outer periphery of the roller 46 in the proximity of the opposite end thereof, and are in substnatial alignment with the first teeth 48 for engagement with the perforations provided along the opposite edge of the strip 14. A pressure roller 52 is yieldably supported in the proximity of the outer periphery of the roller 46 and spans the width thereof as particularly shown in FIG. 2. The roller 52 is provided with a longitudinal central portion 54 of a length substantially equal to the length between the first and second sets of teeth 48 and 50, and is provided with a pair of annular grooves 56 and 58 in substantial alignment with the teeth 48 and 50 whereby the outer periphery of the central portion 54 may be brought into engagement with the outer periphery of the roller 46 without interference with the teeth 48 and 50. Whereas the roller 52 may be yieldably mounted on the support wall 13 in any suitable manner, as shown herein the roller 52 is provided with a centrally disposed longitudinally extending axle 60 carried by an arm member 62 which is pivotally secured at 63 to a post 64, which in turn may be secured to the wall 13 in any suitable manner (not shown). A suitable helical spring 66 is anchored between the arm 62 and the outer face of the wall 13 for constantly urging the roller 52 in a direction toward the roller 46. Of course, when a force sufficiently great for overcoming the force of the spring is applied to the arm 62, the roller 52 may be moved away from the roller 52, as is well known.

The roller 46 is keyed or otherwise suitably secured to a centrally disposed longitudinally extending shaft 68 for rotation simultaneously therewith. The shaft 68 extends through a bushing member 70, and is journalled therein by suitable bearings 72 and 74 for facilitating the rotation of the shaft 68 about its own longitudinal axis. The bushing 70 extends through an aperture 76 provided in the wall 13, and is provided with an outwardly extending circumferential flange on the outer periphery thereof for engagement with one face of the wall 13, and is provided with an outwardly extending circumferential flange on the outer periphery thereof for engagement with one face of the wall 13 whereby the bushing 70 may be secured to the wall 13 by suitable screws 78, or the like. A substantially cylindrical drum member 80 is secured to the end of the shaft 68 oppositely disposed with respect to the roller 46, and rotates simultaneously therewith. An annular groove 82 is provided in the outer periphery of the drum 80 providing a reduced diameter neck portion 84. A plurality of circumferentially spaced pin or stud members 86 extend across the width of the groove 82 and are spaced radially outwardly from the outer periphery of the reduced neck member 84. The pins 86 are spaced apart a distance substantially equal to the length of one frame of the film strip 14 for a purpose as will be hereinafter set forth.

A brake shoe 88 is disposed in the proximity of the outer periphery of the cylinder or drum 80 and is carried by a pivotal arm 90. The arm 90 may be secured at 92 to the rear wall (not shown) of the housing (not shown) of the apparatus 10, if desired, and is mounted in such a manner that the pivot point of the arm 90 is at 92, with the brake member 88 being disposed at one end of the arm 90, and the opposite end of the arm being pivotally secured to the actuator arm 94 of a suitable solenoid 96. When the solenoid is activated in a manner for moving the brake shoe 88 into engagement with the outer periphery of the drum 80, the rotation of the drum 80 will cease, thus stopping the rotation of the roller 46 for a purpose as will be hereinafter set forth.

An adjustable pawl member 98 is pivotally secured to the arm 90 by a suitable pivot pin 100 and is positioned in such a manner as to be in alignment with the annular recess 82 of the drum 80. The pawl 98 is provided with a pair of spaced dogs 102 and 104 spaced apart a selected distance corresponding to the distance between the pins 86. In addition, the pawl 98 is provided with a substantial straight edge 106 oppositely disposed from the dogs 102 and 104, and engagable with an adjustable stop member 108 which is threadedly secured to a bracket member 110, which in turn is secured to the arm 90. The pawl 98 moves toward and away from the drum 80 simultaneously with the movement of the shoe 88 and cooperates therewith for stopping the rotation of the drum 80 at a precise preselected position with respect to the frames of the film strip 14 as will be hereinafter set forth.

The cutting apparatus 20 is substantially identical with the cutting apparatus set forth in our aforementioned co-pending application, and comprises a pair of pivotal cutting arms 110 and 112 having the inwardly directed ends thereof extending thorugh an opening (not shown) in the wall 13 and secured together by a suitable hinge member 111. The lower edge of each arm 110 and 112, as viewed in the drawings, is provided with a cutting edge or element 114 and 116, respectively. An actuator arm 118 is suitably secured to the outer face of the cutting arm 110 and extends through the opening (not shown) for pivotal connection with a suitable lever (not shown) which in turn is pivotally connected with the reciprocal actuator arm (not shown) of a solenoid 120. In addition, the inner end of the actuator arm 118 is secured or anchored to one end of a suitable helical spring (not shown), which in turn is anchored in any suitable manner to the inner surface of the wall 13. The spring constantly urges the actuator arm 118 in a direction which provides a normal position for the arm 110 spaced from the cutting arm 112.

An actuator arm 122 similar to the actuator arm 118 is secured to the outer face of the cutting arm 112 and extends through the opening (not shown) in the wall 13 into pivotal connection with a lever arm (not shown which in turn is pivotally secured to the actuator arm (not shown) of a solenoid 124. The inner end of the actuator arm 122 is secured or anchored to a suitable helical spring (not shown) anchored to the inner periphery of the housing (not shown) of the apparatus 10 in any well known manner (not shown). The spring constantly urges the actuator arm 122 in a direction for providing a normal position for the clamp arm 112 out of engagement with the cutting arm 118. In addition, it is preferable that the solenoid 120 be of a type wherein the normal position of the actuator arm thereof is extended, and the solenoid 124 be of the type wherein the normal position of the actuator arm thereof is contracted, but not limited thereto.

A vertically disposed cutting block member 126, as viewed in the drawings, is disposed below the cutting arms 110 and 112 and in substantial alignment with the hinge member 111 and is disposed in such a manner that there is a slight clearance between the cutting elements 114 and 116 and the upper end 128 of the block 126 when the cutting arms 110 and 112 are moved in directions toward each other, as will be hereinafter set forth. The block 126 is suitable secured to a mounting plate 130 which may be secured to the wall 13 in any suitable manner, such as by bolts 132. The web 14 extends from the alignment apparatus 18 through or between the cutting arms 110 and 112 and along one or the other side of the block 126 during operation of the apparatus. For example, when the web 16 is being reeled or wound onto the reel 24 (FIG. 5), the web 14 passes along the right-hand side of the block 126 as viewed in the drawings. When the web 14 is being wound onto the reel 22, the web passes along the left-hand side of the block 126, as shown in FIG. 1.

A first holding element 134 is pivotally secured to the wall 13 by a suitable journal member 136 and comprises a substantially inverted L-shaped body member 138 having a leaf spring 140, or the like, bolted or otherwise secured to the inwardly directed surface thereof. In one pivotal position of the holding element 134, the leaf spring 140 is in yieldable engagement with the right-hand face of the block 126 and the outer end 142 of the body 138 is in engagement with the outer surface of the arm 122. In another pivotal position of the element 134, the leaf spring 140 is out of engagement with the block 126 and the end 142 is out of engagement with the arm 122. The axis of the journal 136 extends through an aperture (not shown) in the wall 13 and is rotatable with respect thereto. A contactor arm (not shown) is secured to the inwardly directed end of the axis of the journal 136 in the same manner as set forth in our aforementioned application, and is biased or spring urged by a helical overload spring (not shown) anchored between the contactor arm and the housing (not shown) in any suitable manner. When the holding element 134 is in engagement with the arm 122, the overload spring holds the end 142 firmly in engagement therewith as well as assures that the leaf spring 140 will be in engagement with the block 126. When the arm 122 is actuated in a manner as will be hereinafter set forth for moving in a direction away from the arm 118, the body 138 is pivoted about the journal 136 and simultaneously rotates the contact arm (not shown) in a corresponding direction toward a suitable switching apparatus 144 secured to the inner face of the wall 13 in the proximity of the contact arm (not shown). When the contact arm is moved sufficiently for passing "dead center" of the rotational axis thereof, the overload spring then functions for moving the contact arm into engagement with the switch arm of the switching apparatus 144 for actuation of the switch 144. The switch 144 is operably connected with one of the motors, such as the motor 28, for intermittent actuation thereof as will be hereinafter set forth in detail.

A holding element 146, substantially identical to the holding element 134 but oppositely disposed with respect thereto is similarly pivotally secured to the wall 13 by a suitable journal 148 and carries a leaf spring 150 on the inwardly directed face thereof for alternately engaging the left-hand side of the block 126. It is to be noted that the leaf spring 150 does not engage the block 126 when the leaf spring 140 is in engagement with the block, and similarly, the spring 140 does not engage the block 126 when the spring 150 is in engagement with the block. The holding element 146 is also substantially L-shaped, and the outer end 152 thereof is adapted for engagement with the outer surface of the arm 118 in the same manner and for the same purpose as the end 142 of the body 138. The axis of the journal 148 extends through an aperture (not shown) in the wall 13 and is suitably secured to a contact arm (not shown) which is substantially identical to the contact arm associated with the journal 136, and which rotates simultaneously with the axis 148. The contact arm is biased or spring urged by a suitable helical spring (not shown) which is anchored between the arm and the wall 13 or housing (not shown) in any well known manner. As hereinbefore set forth in connection with the operation of the holding element 146, the end 152 is in engagement with the arm 118 and the leaf spring 150 is in engagement with the block 126; and in another pivotal position of the element 146, the element 146 and spring 150 are out of engagement with the arm 118 and block 126, respectively. When the element 146 is pivoted by the pivotal movement of the arm 118 and through a sufficient distance, the contact arm associated therewith passes over the "dead center" position therefor, and the biasing spring moves the contact arm into engagement with a switching apparatus 154 which is secured on the inner face of the wall 13 in the proximity of the contact arm associated with the element 146. The contact arm engages the switching apparatus 154 for actuation thereof. The switching apparatus 154 is operably connected with the other motor, such as the motor 26, for intermittent actuation thereof as will be hereinafter set forth.

Figure 5:
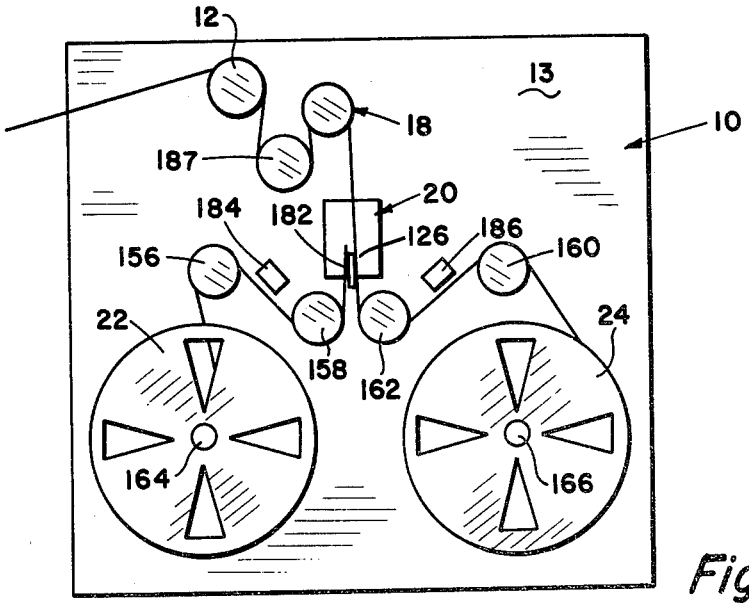
FIG. 5 is a front elevational view of a modified web cutting and splicing apparatus embodying the invention.

It is preferable to provide a plurality of idler rollers interposed between the cutting apparatus 20 and the reels 22 and 24 for facilitating the movement of the web 14 onto the reels. As particularly shown herein, a first idler roller 156 is suitably journalled on the wall 13 in the proximity of the reel 22, and a second idler roller 158 is suitably journalled on the wall 13 in the proximity of the cutting apparatus 10 whereby the web 14 may pass under the roller 158, over the roller 156, as shown in FIG. 1, and onto the reel 22. A third idler roller 160 is suitably journalled on the wall 13 in the proximity of the reel 24, and a fourth idler roller 162 is suitably journalled on the wall 13 in the proximity of the cutting apparatus 20 whereby the web 14 may pass under the roller 162, over the roller 160 and onto the reel 24 as shown in FIG. 5. Of course, any suitable number and arrangement of idlers may be utilized as desired for facilitating the transporting of the web 14 to either the reel 22 or the reel 24 during use of the apparatus 10, as will be hereinafter set forth.

The reel 22 is carried by a suitable axle 164 (FIG. 5) which extends rotatably through an aperture (not shown) in the wall 13. The axle 164 is operably connected with the drive shaft (not shown) of the motor 26 in any suitable manner for rotation thereby. As set forth in our co-pending application, it is preferable that an endless belt, chain, or the like (not shown) extend between a suitable gear train or pulley arrangement carried by the motor drive shaft and the axle 164, as is well known, for transmitting rotation to the reel 22. The reel 24 is carried by a suitable axle 166 which also extends rotatably through an aperture (not shown) in the wall 13. The axle 166 is operably connected with the drive shaft (not shown) of the motor 28 in any suitable manner for rotation thereby. As shown in our aforementioned co-pending application, it is preferable to provide an endless belt or chain (not shown) which extends between a suitable gear train or pulley arrangement (not shown) carried by the motor drive shaft and the axle 166 as is well known, for transmitting rotation to the reel 24.

Figure 4:
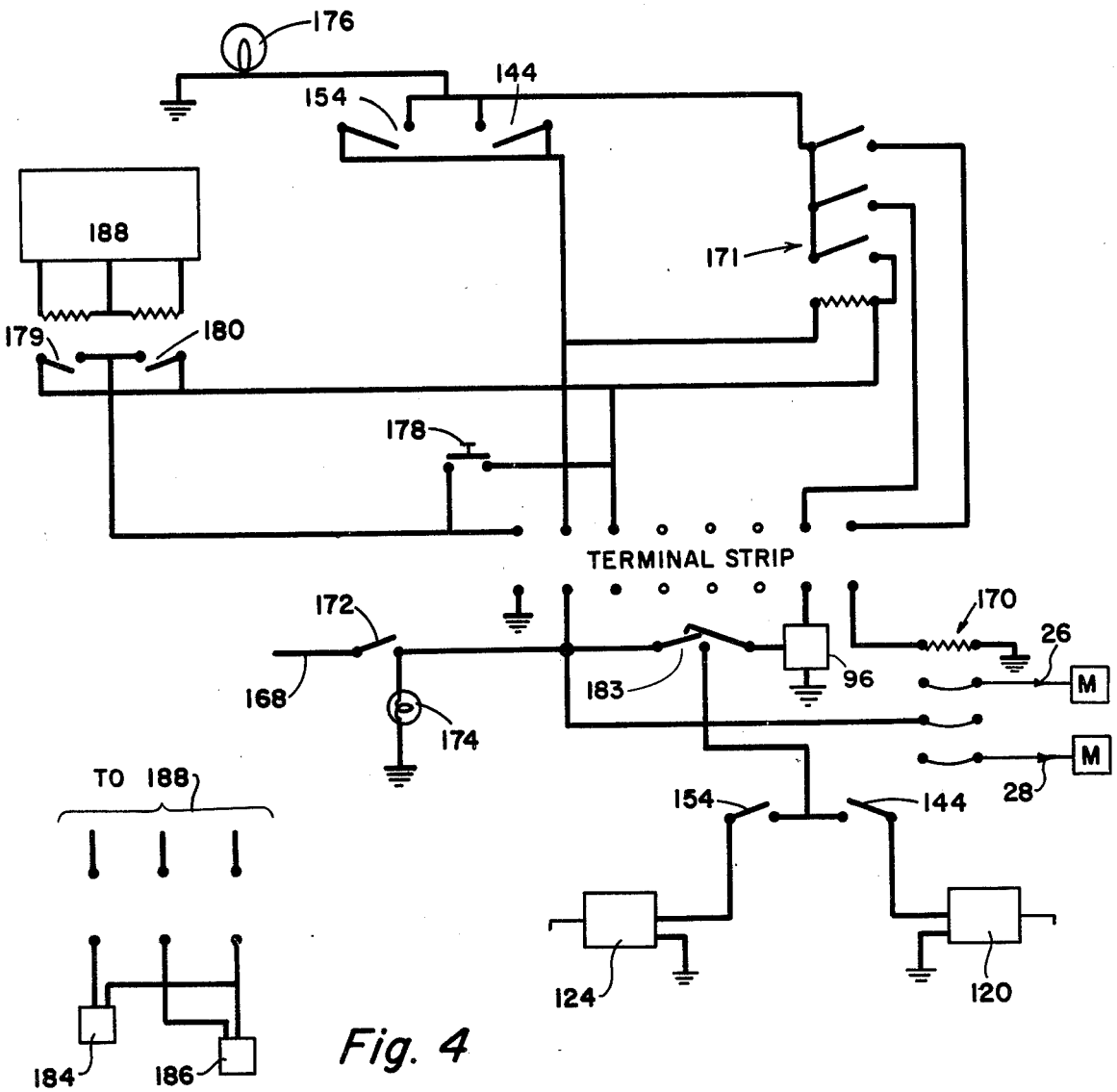
FIG. 4 is a schematic view of an electrical circuit for a web cutting and splicing apparatus embodying the invention.

The power for operation of the apparatus 10 may be the usual or standard 110 AC house current as indicated at 168 in FIG. 4. The switching devices 144 and 154 are preferably operably connected with suitable relays generally indicated at 170 and 171. The solenoids 96, 120 and 124 are preferably operably connected with the current source 168. It is also preferably to provide a master switch 172 and pilot light 174 operably connected with the relays 170 and 171, and a suitable ready light 176 operably connected with the switch devices 144 and 154. A manual override switch 178 is also provided in the system for manual operation of the apparatus 10 in the event the automatic operation thereof fails for some reason. Of course, suitable switches 179 and 180 are operably connected with the brake solenoid 96 and sensing coils 184 and 186 as well as the switches 144 and 154 for synchronized actuation of the braking shoe 88 and the cutting apparatus 20 and the actuation of the motors 26 and 28. In addition, a suitable cutter switch 183 is provided in the system as particularly shown in FIG. 4.

In operation, assuming that the web 14 is a strip of movie film, the web 14 must be initially threaded or inserted through the apparatus 10 by passing the leading end of the web 14 around the pulley 12, through the holding and/or sensing apparatus 16, around the alignment apparatus 18, through the cutting apparatus 20, and onto one of the reels, such as the reel 22. The reel 22 will now be the driven or powered take-up reel during the initial operation of the apparatus 10. A second reel, such as the reel 24, which is empty, is installed on the shaft 166 in any well known manner, and the usual leader 182 normally provided with a reel of this type equipment is directed over the idler 160 and under the idler 162 in such a manner that the free end of the leader 182 is inserted into the cutter apparatus 20 and positioned against the right-hand side of the block 126 and against the inner face of the arm 112. A suitable length of double-faced pressure sensitive tape (not shown) is adhered to the extreme outer end of the leader 182 in the manner set forth in our co-pending application, and is disposed in the proximity of the inner face of the arm 112. The holding element 134 is positioned in such a manner that the leaf spring 140 is in yielding engagement with the block 126 as shown in FIG. 1 for holding the leader 182 securely against the block. In this position of the element 134, the switching apparatus 144 is not activated, and the motor 28 is inactive. At the same time, the holding element 146 is positioned in such a manner that the switching apparatus 154 is activated or closed, thus placing the motor 26 in the electric circuit of the apparatus 10.

When the master switch 172 is manually closed, power is transmitted to the apparatus 10, and the motor 26 begins the rotation of the reel 22 for pulling the web 14 through the apparatus 10. As hereinbefore set forth, assuming that the web 14 is movie film, a suitable length of magnetic material (not shown) or other material which may be sensed by the rollers 30 and 32 is glued or otherwise adhered to the film strip at preselected intervals, as set forth in our co-pending application. The material is preferably spaced at intervals of approximately two thousand feet along the length of the web 14, but the positioning of the material is preselected in accordance with the position of the frames of the film at the site wherein the material is to be adhered. In addition, the material is adhered to the proper side of the film 14 whereby the proper side thereof passes across the sensing rollers 30 and 32 for energizing of the sensors. The sensing rollers 30 and 32 activate the solenoid 96 which moves the brake shoe 88 into engagement with the outer periphery of the drum 80 for slowing down the rotation thereof. At the same time, the pawl 98 is moved into a position wherein the dogs 102 and 104 extending into the annular recess 82. Assuming that the drum 80 is rotating counterclockwise as indicated by the arrow A, the first post 86 to move into engagement with the dog 104 will be stopped for a complete cessation of the rotation of the drum 80. In the event a post 86 is initially disposed between the dogs 102 and 104 when the pawl is moved into the recess 82, the post 86 will engage the right-hand side of the dog 102, as viewed in FIG. 3, and pivot the pawl in a clockwise direction about the pivot axis 100. This action brings the dog 104 directly into the path of the next succeeding post 86 and the engagement of the post 86 therewith positively precludes any further movement of the drum 80 until the pawl 98 is removed from the position within the recess 82. As hereinbefore set forth, the posts 86 are positioned in coordination with the teeth 50 and 48 in such a manner that the stopping of the drum 80 causes the film or web 14 to stop in such a manner that the portion of the web 14 disposed at the cutting edges 114 and 116 is between a pair of adjacent frames of the film strip. Simultaneously with the activation of the solenoid 96, the solenoid 124 of the cutting arm 118 will be activated for moving the arm 118 in a direction toward the arm 112. As the cutting element 114 moves across the outer tip 128 of the block 126, the film 14 will be severed and released from connection with the remaining portion of the film strip. The arm 110 continues to move and engages the arm 112, carrying with it the free end of the remaining film strip. The pressure of the engagement of the arm 110 with the arm 112 adheres the cut end of the film strip to the tape of the leader 182, thus connecting the remaining portion of the film strip 14 to the leader 182.

As the arm 110 is moved in the direction toward the arm 112, the switching apparatus 154 is disengaged, thus deactivating the motor 26. Of course, the arm 112 is moved in a direction for moving the holding element 134 in a manner for activating the switch 144 and activating the motor 28 whereby the reel 24 now becomes the driving force for moving the strip 14 through the apparatus 10.

As soon as the cutting and switching operation has been accomplished, the brake apparatus is de-energized and the pressure of the shoe 88 against the drum 80 is released wherein the continuous movement of the film 14 may be restored. It is to be noted that the stoppage of the movement of the web 16 is momentary and causes substantially no effect in the overall forward movement of the web. However, in the event any slack occurs in the web 14 upstream of the braking apparatus 80-88 during a cutting operation, suitable pinch rollers, or the like (not shown) may be provided for compensating for any such slack, as is well known. In addition, the pressure of the rollers 38 and 40 against the rollers 30 and 32 not only maintains the film in efficient contact with the sensing roller for operation thereof, but also substantially preclude an upstream slack in the web 14.

When the solenoids are deactivated, the cutter arms 110 and 112 return to the normal disengaged postion therefor, as set forth in our co-pending application, and the operation may be repeated until the entire continuous length of the web 14 has been divided or separated into a plurality of lengths of substantially any desired dimension.

When the reel 22 has been filled with the desired length of web 14 in the manner hereinbefore set forth, the reel may be manually removed from the apparatus 10 and a new or empty reel may be substituted therefor. The leader of the newly installed reel may be threaded into the cutter apparatus 20 in the manner as hereinbefore set forth, and the operation of the apparatus may be continued for winding a plurality of reels with the predetermined lengths of the web material. Of course, in the event the sensing rollers do not detect a material length adhered to the film, or if there is any other reason for cutting the web at a point wherein the clamping apparatus 16 and cutting apparatus 20 do not automatically function, the override switch 178 may be utilized in the normal manner for manual operation of the apparatus 10.

Referring now to FIG. 5, the apparatus 10 is modified to include magnetic-type sensors 184 and 186 in lieu of the sensor rollers 30 and 32. In this situation, the clamping or sensing apparatus 16 may be eliminated, and a suitable idler pulley 187 may be interposed between the pulley 12 and alignment apparatus 18. In addition, the material length to be adhered to the film strip is preferably a thin shim stock (not shown) of suitable steel material which may be detected by the magnetic sensor 184 and 186. The thin material is preferably secured to the film strip 14 by clear scotch tape which covered one full frame, but is undetectable when the film strip is projected onto a movie screen (not shown). In the operation of the apparatus 10 having the magnetic-type sensors 184 and 186 provided thereon, the sensors 184 and 186 are operably connected with the printed circuit board 188 in lieu of the sensor 30 and 32, and as the steel shim passes one or the other of the sensors 184 and 186, the solenoid 96 and solenoid 120 and/or 124 are activated in the manner as hereinbefore set forth for cutting the strip 14 into the predetermined lengths and at the predetermined position therealong. In the embodiment wherein the sensing rollers 30 and 32 are utilized, the web is normally severed in such a manner that the material length adhered to the film strip remains with the unsevered portion of the film and thus becomes the first portion of the film to be wound on the next succeeding reel. In the embodiment of the apparatus 10 wherein the magnetic sensors 184 and 186 are utilized, the web is normally severed in such a manner that the steel shim remains with the severed portion of the film and is on the last portion of the film winding onto the storage reel.

It may be preferable to provide a first pair of transversely spaced lugs 125 (only one of which is shown in FIG. 1) on one side of the block 126 for engaging the perforations of the film strip 14, and a second pair of transversely spaced lugs 127 (only one of which is shown in the drawings) on the opposite side of the block 126 for engagement with the perforations of the web or film strip 14. The lugs 125 and 127 cooperate with the leaf springs 140 and 150, respectively, for facilitating holding of the film strip 14 in the desired orientation therefor during use of the apparatus 10.

From the foregoing, it will be apparent that the present invention provides a novel web cutting and splicing apparatus wherein a substantially continuously moving web may be severed into a multitude of smaller lengths of predetermined dimensions, and winding the smaller lengths onto storage reels. The novel device automatically senses a predetermined position in the overall length of the continuous web and momentarily stops the forward movement of the web whereby a cutting apparatus automatically cuts the web and adheres the outer end of the remaining web to a leader of a new or empty storage roll, whereby the winding operation may be continued until the entire web has been divided into the desired shorter lengths. In addition, an alignment apparatus is provided whereby the web may be severed at precise locations along the length thereof in order that a film strip, or the like, may be severed exactly between a pair of adjacent frames on the film. In this manner repeated cutting and splicing operations performed on the film strip may be made without destroying the continuity of the film during the showing of the film strip.

Whereas the present invention has been described in particular relation to the drawings attached hereto, it should be understood that other and further modifications, apart from those shown or suggested herein, may be made within the spirit and scope of this invention.

What is claimed:

1. Web cutting and splicing apparatus comprising pulley means for initially receiving the web therearound, alignment means spaced from the pulley means for receiving the web therearound, braking means operably connected with the alignment means, actuating means cooperating between the web and the braking means for selective actuation of the braking means to momentarily hold the web against longitudinal movement, cutting means spaced from the alignment means for receiving the web therethrough, means operably connected with the cutting means for actuation simultaneously with the actuating means for severing the web at a predetermined position thereon, first reel means spaced from the cutting means and having a leader thereon for receiving the leading end of the web thereon, first power means operably connected with the first reel means for selective rotation thereof to move the web from the pulley means to the first reel means for winding the web thereon, second reel means journalled in spaced relation to the first reel means and having a leader thereon, second power means operably connected with the second reel means for selective rotation thereof, means operably connected between said first and second power means for alternate actuation thereof, means cooperating between said second reel means and the cutting means for securing the leading end of the severed web to the leader on the second reel means for transferring the winding of the web from the first reel means to the second reel means, and means cooperating between the first and second power means for stopping the actuation of the first power means upon the severing of the web and simultaneously starting the actuation of the second power means.

2. Web cutting and splicing apparatus as set forth in claim 1 wherein the alignment means comprises means cooperating with the web for positioning the web in the cutter means during a cutting operation for cutting of the web in preselected precise locations along the length thereof.

3. Web cutting and splicing apparatus as set forth in claim 1 wherein the alignment means comprises roller means for receiving the web thereover, web engaging means provided on the roller means for engaging the web in a specific orientation therebetween whereby the alignment between the web and the cutting means may be controlled for precision location of the severing of the web.

4. Web cutting and splicing apparatus as set forth in claim 1 wherein said actuating means comprises sensing means cooperating with the movement of the web for actuation of the braking means in accordance with a preselected position of the web travelling through the apparatus.

5. Web cutting and splicing apparatus as set forth in claim 4 wherein the sensing means comprises sensing rollers receiving the web thereacross for detecting preselected positions along the length of the web for actuation of the braking means.

6. Web cutting and splicing apparatus as set forth in claim 5 wherein the sensing means includes pressure roller means cooperating with the sensing rollers for assuring an efficient engagement of the web with the sensing rollers for facilitating the sensing operation.

7. Web cutting and splicing apparatus as set forth in claim 4 wherein the sensing means comprises magnetic-type sensors receiving the web in the proximity thereof for detecting preselected positions along the length of the web for actuation of the braking means.

* * * * *